US012553629B2

(12) United States Patent
Delanghe et al.

(10) Patent No.: US 12,553,629 B2
(45) Date of Patent: Feb. 17, 2026

(54) HEAT PUMP AND METHOD FOR INSTALLING THE SAME

(71) Applicants: DAIKIN INDUSTRIES, LTD., Osaka (JP); DAIKIN EUROPE N.V., Oostend (BE)

(72) Inventors: Eddy Delanghe, Oostend (BE); Alain Coorens, Oostend (BE); Nicolas Heintz, Oostend (BE); Jonas Dangreau, Oostend (BE); Robbe De Clerck, Oostend (BE); Paul Demeyer, Oostend (BE); Tim Coessens, Oostend (BE)

(73) Assignees: DAIKIN INDUSTRIES, LTD., Osaka (JP); DAIKIN EUROPE N.V., Ostend (BE)

( * ) Notice: Subject to any disclaimer, the term of this patent is extended or adjusted under 35 U.S.C. 154(b) by 241 days.

(21) Appl. No.: 17/760,646

(22) PCT Filed: Dec. 21, 2020

(86) PCT No.: PCT/JP2020/047695
§ 371 (c)(1),
(2) Date: Mar. 15, 2022

(87) PCT Pub. No.: WO2021/125354
PCT Pub. Date: Jun. 24, 2021

(65) Prior Publication Data

US 2022/0341613 A1 Oct. 27, 2022

(30) Foreign Application Priority Data

Dec. 20, 2019 (EP) ..... 19218593

(51) Int. Cl.
*F24F 11/36* (2018.01)
*F24F 1/0007* (2019.01)
(Continued)

(52) U.S. Cl.
CPC ..... *F24F 11/36* (2018.01); *F24F 1/00073* (2019.02); *F24F 1/0059* (2013.01); *F24F 13/20* (2013.01)

(58) Field of Classification Search
CPC ..... F24F 11/36; F24F 13/20
See application file for complete search history.

(56) References Cited

U.S. PATENT DOCUMENTS 3,241,329 A * 3/1966 Fritch, Jr. ..... F25D 3/102 62/239
2019/0170604 A1 6/2019 Kester
2019/0390873 A1 12/2019 Suzuki

FOREIGN PATENT DOCUMENTS

AU 459154 B2 7/1973
DE 10 2009 029 392 A1 3/2011
(Continued)

OTHER PUBLICATIONS

WO2018167861A1 Translation (Year: 2018).*
(Continued)

*Primary Examiner* — Schyler S Sanks
(74) *Attorney, Agent, or Firm* — Spencer Fane LLP

(57) ABSTRACT

A heat pump including a refrigerant circuit configured to circulate flammable refrigerant, and an indoor unit configured to be arranged in an indoor space. The refrigerant circuit has a compressor, a utilisation-side heat exchanger, an expansion device and a heat-source-side heat exchanger connected by piping. The an indoor unit includes an outer casing having a top, and a sealed container accommodated in the outer casing. The sealed container has a bottom and a top and accommodates at least one of the compressor, the utilisation-side heat exchanger, the expansion device, and the heat-source-side heat exchanger. The sealed container
(Continued)

has a release opening to exhaust leaking refrigerant to an exterior of the outer casing of the indoor unit.

16 Claims, 6 Drawing Sheets

(51) Int. Cl.
*F24F 1/0059* (2019.01)
*F24F 13/20* (2006.01)

(56) References Cited

FOREIGN PATENT DOCUMENTS

| | | | | |
|---|---|---|---|---|
| DE | 10 2019 101 427 | A1 | 7/2020 | |
| EP | 0 726 430 | A2 | 8/1996 | |
| EP | 3 118 537 | A1 | 1/2017 | |
| EP | 3 139 105 | A1 | 3/2017 | |
| EP | 3 222 941 | A1 | 9/2017 | |
| FR | 2827948 | B1 * | 7/2016 | ..... B08B 15/02 |
| FR | 3070755 | A1 | 3/2019 | |
| JP | 10-47751 | A | 2/1998 | |
| JP | 2016-217567 | A | 12/2016 | |
| JP | 2019-184090 | A | 10/2019 | |
| WO | 2017/090104 | A1 | 6/2017 | |
| WO | WO-2018167861 | A1 * | 9/2018 | ..... F24F 1/0059 |

OTHER PUBLICATIONS

FR-2827948-B1 Translation (Year: 2016).*
International Search Report of corresponding PCT Application No. PCT/JP2020/047695 dated Mar. 24, 2021.
European Search Report of corresponding EP Application No. 19 21 8593.2 dated Jul. 6, 2020.
International Preliminary Report of corresponding PCT Application No. PCT/JP2020/047695 dated Jun. 30, 2022.
International Electrotechnical Commission (IEC) Standard 60335-2-40:2018—Household and Similar Electrical Appliances—Safety—Part 2-40: Particular Requirements for Electrical Heat Pumps, Air-Conditioners and Dehumidifiers, 2018.
Directive 1999/92/EC of the European Parliament and of the Council of Dec. 16, 1999; EN 2007; pp. 1-12.

* cited by examiner

HEAT PUMP AND METHOD FOR INSTALLING THE SAME

CROSS-REFERENCE TO RELATED APPLICATIONS

This U.S. National stage application claims priority under 35 U.S.C. § 119(a) to European Patent Application No. 19218593.2, filed in Europe on Dec. 20, 2019, the entire contents of which are hereby incorporated herein by reference.

BACKGROUND

Field of the Invention

The present invention relates to a heat pump and a method for installing the same.

Background Information

Development of modern heat pumps is facing a vast variety of requirements due to environmental and technical challenges. On the one hand, heat pumps should work as efficient as possible, whereas, on the other hand, the refrigerant used therein should avoid any environmental risks, such as ozone depletion or the potential to negatively influence the global warming.

To address said requirements, refrigerants used in modern heat pumps were switched from non-flammable refrigerants, such as R410A, towards flammable refrigerants, such as, e.g., R32, which work more efficient than the non-flammable ones, while achieving a reduced (or eliminated) ozone depletion potential and a reduced global warming potential (to be referred to as "GWP" hereinafter).

However, when switching from non-flammable refrigerants to flammable refrigerants, increased care needs to be taken when handling said flammable refrigerants. In fact, leakage of flammable refrigerant into an indoor space, in which the heat pump or at least a part of the heat pump, such as an indoor unit thereof, is installed, causes an indoor refrigerant concentration to increase, which potentially leads to formation of a flammable concentration region.

Such a concentration of leaked flammable refrigerant is particularly dangerous, as flammable refrigerant oftentimes has a density greater than air under atmospheric pressure, such that the leaking flammable refrigerant accumulates in the bottom part of the indoor space, i.e. in a floor surface region thereof. This may lead to an inflammation and risks for users, buildings, etc.

Accordingly, it is desired to avoid such a formation of a flammable concentration region in an indoor space.

To do so, current heat pumps used in indoor spaces, as described, e.g. in EP 3222941 A1, are provided with complex systems of sensors and at least one ventilation system, such as a fan, needs to be installed in the indoor space. Said commonly known systems permanently detect the refrigerant concentration inside the indoor space and, in case of leaking flammable refrigerant, activate the fan to circulate air in the indoor space and disperse the leaking flammable refrigerant inside the indoor space. Accordingly, the formation of a flammable concentration region inside the indoor space can be avoided. Yet, EP 3222941 A1 requires a very complex system as well as permanent monitoring.

To avoid such a complex heat pump system, FR 2827948 B1 describes an alternative approach having a box containing at least part of the heat pump system and having a sealed conduit that opens to the exterior of the building, in which at least the indoor unit of the heat pump is mounted. Accordingly, an air conditioning device is provided, wherein the leaking refrigerant can be exhausted to the exterior of the building. Nonetheless, this provokes further issues and risks stemming from a potential clogging of the conduit due to pollution, animals, dust, or the like surrounding the conduit opening at the exterior of the building. This is particularly dangerous when refrigerant is leaking inside the box and cannot be exhausted to the environment. This may lead to an increased refrigerant pressure inside the box and an increased inflammation risk.

To ensure a safe application of heat pumps and/or at least indoor units thereof inside indoor spaces, international standards, namely IEC60335-1 (Ed5) and IEC60335-2-40 (FDIS Ed6) have been established. Therein, international rules for a required dispersion height of potentially leaking refrigerant inside heat pump systems have been defined. This aims to avoid a flammable refrigerant concentration, especially in small indoor spaces.

By defining a minimum exhaust height, which depends on the available floorspace of the indoor space and the amount of flammable refrigerant used in the heat pump, a sufficient dispersion of the flammable refrigerant having a greater density than air under atmospheric pressure inside an indoor space, can be ensured.

When considering a flammable refrigerant having a higher density than air under atmospheric pressure, the above-noted international standards, which are further exemplified, e.g., in EP 3139105 A1, accordingly define the general rule that, when having a fixed indoor space floor area, the dilution improves with a higher release height and, hence, reduces the potential formation of a flammable concentration region.

In light of the present specification, the term "small indoor space" is to be understood, as a room, e.g. in a domestic house, such as a private household, having an overall space of equal to or less than 200 $m^2$.

Yet, the presently known systems still require ventilation to fulfill said requirements in small rooms and to sufficiently disperse leaking refrigerant. Consequently, it is challenging to install a simple and safe heat pump system, or at least an indoor unit thereof, in particularly small indoor spaces, while using efficient flammable refrigerants without extra measures, such as ventilation systems.

SUMMARY OF INVENTION

In view of the above, it is an object of the present invention to provide a heat pump having a simple configuration and a method for installing the same, which enables to avoid concentration of leaking flammable refrigerant inside a small indoor space.

In other words, it is a key idea of the present invention to provide a simple heat pump configuration and a method for installing the same, which achieve a sufficient and reliable dilution of leaking flammable refrigerant inside a small indoor space and, thus, at least reduce the risk of inflammation.

This object is solved by means of a heat pump and/or a method according to any of the claims.

According to a first aspect of the invention, a heat pump comprises a refrigerant circuit configured to circulate flammable refrigerant as well as an indoor unit configured to be arranged in an indoor space. The refrigerant circuit comprises a compressor, a utilisation-side heat exchanger, an expansion device and a heat-source-side heat exchanger connected by piping. Further, the indoor unit comprises an outer casing having a top, and a sealed container accommodated in the outer casing, wherein the sealed container has a bottom and a top and accommodates at least one of the compressor, utilisation-side heat exchanger, the expansion device and the heat-source-side heat exchanger. In this context, the sealed container accommodates at least potential leaking point such as the mentioned components (compressor, utilisation-side heat exchanger, the expansion device and the heat-source-side heat exchanger) itself, brazing points, piping with sharp bends and the like. The sealed container has a release opening to exhaust leaking refrigerant to the exterior of the outer casing of the indoor unit.

The "expansion device" should not only be understood as covering an expansion valve, but should also cover a capillary tube, or the like exerting expansion to compressed refrigerant inside the refrigerant circuit.

The heat pump may e.g. be an air heat pump using air as heat source or a ground source heat pump using the ground as heat source. The heat pump may be used for e.g. producing domestic hot water, air conditioning (heating and/or cooling) and the like. In an air heat pump, a heat source unit is provided which may comprise the compressor, the expansion valve and the heat-source-side heat exchanger of the refrigerant circuit. The heat source unit may be configured as an outdoor unit disposed outdoors. However, there are also air heat pumps in which the heat source unit is physically disposed indoors though exchanging heat with outdoor air as heat source. The indoor unit is configured to be arranged in an indoor space comprising a utilization side heat exchanger. In a ground source heat pump, the indoor unit may comprise the whole refrigerant circuit including the compressor, the expansion valve, the heat source side heat exchanger and the utilization side heat exchanger.

Even further, the heat pump may be an enhanced tightness refrigerating system. An "enhanced tightness refrigerating system" is a system in which the indoor unit/-s is/are designed and fabricated to ensure a high level of confidence that large refrigerant leak rates will not occur in normal and abnormal operation. Refrigerating systems that fulfil all of the conditions defined in clause 22.125 of IEC 60335-2-40: 2018 shall be considered enhanced tightness refrigerating systems.

The "flammable refrigerant" described above is to be understood as having a density higher than air under atmospheric pressure. "Flammable refrigerant" may be refrigerant classified as class A2L, A2 or A3 according to ISO 817, particularly refrigerant classified as class A2L.

The above described arrangement provides a simple configuration of a heat pump. Said simple configuration achieves a secure operation of the indoor unit configured to be arranged in an indoor space, as potentially leaking flammable refrigerant is securely gathered in the sealed container. If the gathered amount of flammable refrigerant is sufficiently high, it gets "automatically" exhausted to the exterior of the outer casing of the indoor unit into the indoor space at a predetermined location. This provides for sufficient dispersion inside said indoor space, which reduces the risk of an inflammation inside the indoor space. Such a configuration is especially advantageous in small indoor spaces, for example in domestic application. As a consequence, an appropriate release height of leaking refrigerant may easily be set. In this context, one may understand the release height as the sum of the installed height and the release offset. The installed height is the height of the bottom of the appliance (e.g. the indoor unit or more particularly the outer casing) relative to the floor of the room after installation. For portable or floor mounted indoor units the installed height is for example 0 m. For window mounted indoor units the installed height may be 1 m, for wall-mounted indoor units the install height may be 1.8 m and for ceiling mounted indoor units, the install height may be 2.2 m. The release offset is the distance from the bottom of the indoor unit or outer casing (appliance) to the release opening where refrigerant can leave the indoor unit in the event of a refrigerant leak. The present invention enables to appropriately adjust the release offset.

According to a second aspect, the release opening is arranged in the top of the sealed container, and the sealed container protrudes through the top of the outer casing of the indoor unit.

Thus, leaking refrigerant can be exhausted on the upper side, i.e. at the top, of the indoor unit. Accordingly, an improved dilution of the flammable refrigerant inside the indoor space can be ensured, as the leaking flammable refrigerant can be exhausted as high as possible. Additionally, no further sealed pipe or the like is required and a simple configuration of the heat pump, particularly the indoor unit thereof, can be maintained.

This reduces the risk of an inflammation and, hence, reduces the risks linked to the efficient flammable refrigerants.

According to a third aspect, the sealed container alternatively comprises a chimney having a first and a second end. The first end of the chimney is in fluid communication with an interior of the sealed container, and the release opening of the sealed container is arranged at the second end of the chimney.

The "chimney" can be understood as a rigid or flexible pipe. Alternatively, the chimney may be made up of several parts that are fluidly, such as airtightly, connected. That is, the chimney may comprise a plurality of sections that are in fluid connection with each other. At least one section of the chimney can be flexible. Using a plurality of sections improves the constructional flexibility, as the sealed container can be arranged at different positions inside the indoor unit while the chimney can be adapted using different sections still maintaining a sufficiently high position of the release opening.

Having a chimney made up of several parts that are fluidly connected also enables to adapt the height of the release opening in relation to the installation situation. That means, when, e.g., the indoor unit is arranged as a wall mounted indoor unit, a longer or shorter chimney may be required to achieve a desired release opening height than in situations, in which the indoor unit is floor standing. For example, a platform may "lift" the indoor unit at a higher position (when measured from the ground of the indoor space), such that also the release opening height is increased by the platform height. Accordingly, a shorter chimney may be required to achieve a desired release opening height.

In an embodiment, the chimney extends from an interior of the outer casing through a wall of the outer casing to an exterior of the outer casing.

Having a chimney in fluid communication with an interior of the sealed container and having a release opening arranged at the second end of the chimney, enables a sufficient dilution inside the indoor space while having a simple arrangement of the heat pump. Further, the provision of a chimney "extending" or "deviating" the release opening position at or beyond the outer casing of the indoor unit provides an increased constructional flexibility and provides a more flexible layout of the indoor unit. That is, the chimney allows to adapt the position of the release opening to the sealed container in the indoor unit, such that, e.g., the release opening and the scaled container can be arranged at different positions inside the indoor unit.

According to a fourth aspect, the release opening is positioned further away from the bottom than the top of the sealed container to exhaust leaking refrigerant into the indoor space.

The leaking refrigerant primarily accumulates inside the sealed container which, in a first step, avoids an emission of said leaking refrigerant to the exterior of the indoor unit into the indoor space. If the flammable refrigerant continues to leak and stream into the sealed container, leaking refrigerant can be exhausted from the release opening to the indoor space at a sufficiently high position. This supports the dilution of the flammable refrigerant inside the indoor space and reduces the risk of a concentration of flammable refrigerant.

According to a fifth aspect, the release opening is positioned above the top of the outer casing.

For example, the chimney extends from the top of the outer casing of the indoor unit or a side of the outer casing of the indoor unit, so that the release opening at the second end of the chimney is distanced from the top of the outer casing of the indoor unit.

It is beneficial that the second end of the chimney further comprises at least one of a cover covering the release opening, a mesh in the release opening, a piping U-turn, a 90° piping turn, and a self-opening lid for closing the release opening at the second end of the chimney and for automatically opening the release opening to exhaust leaking refrigerant while avoiding pollution inside the chimney. In another embodiment, a one-way valve may be disposed in the chimney automatically opening to exhaust leaking refrigerant while avoiding foreign matter and/or humidity to enter the chimney.

Having a release opening positioned above the top of the outer casing further increases the discharge height (release height) of the leaking refrigerant inside the indoor space and, hence, further reduces the risk of a dangerous flammable refrigerant concentration inside the indoor space. Additionally, a high constructional flexibility in the layout of the indoor unit can be achieved.

According to a sixth aspect, the utilisation-side heat exchanger is accommodated in the sealed container.

Arranging the utilisation-side heat exchanger inside the sealed container reduces the risk of an uncontrolled leakage of flammable refrigerant inside the indoor unit and a subsequent uncontrolled leakage into the indoor space. Moreover, heat exchange inside the indoor space can be performed in a safe environment, namely the sealed container, which is in communication with the exterior of the indoor unit via the release opening. Thus, potentially leaking refrigerant from the utilisation-side heat exchanger or the piping connecting the same to the remaining part of the refrigerant circuit, can be safely gathered inside the sealed container and can be exhausted and diluted via the exhaust opening thereof. This provides a simple and safe configuration of the heat pump system without the need for any further ventilation device.

According to a seventh aspect, the refrigerant circuit is accommodated in the sealed container, wherein the sealed container is the outer casing.

In this context, the top of the outer casing and the top of the sealed container may relate to the same element and do not refer to separate elements. Further, the release opening may be arranged at or in the top of said outer casing or if desired, at the second end of the chimney.

Arranging the whole refrigerant circuit and, hence, all potential leaking points including the components of the refrigerant circuit, such as a plate heat exchanger, brazing points, piping with sharp bends and the like, inside the sealed container improves the reliability of the heat pump and prohibits an uncontrolled leakage of refrigerant into the indoor space. That is, the refrigerant circuit is solely connected to the indoor space via the release opening, which improves the safety of the system and ensures that potentially leaking flammable refrigerant can be exhausted from the indoor unit in a controlled manner to ensure sufficient dilution inside the indoor space. Sealed connecting points to and from the interior of the sealed container, which connect at least one element of the above-noted refrigerant circuit inside the sealed container to the remaining part thereof at an exterior of the sealed container, can, hence, also be reduced. This facilitates the design of the sealed container.

According to an eighth aspect, a connection of the at least one of the compressor, the utilisation-side heat exchanger, the expansion device, and the heat-source-side heat exchanger which is/arc accommodated in the sealed container, with the piping is accommodated in the sealed container.

The more elements and their connection to the remaining refrigerant circuit are included inside the sealed container, the lower is the risk of an uncontrolled emission of flammable refrigerant. Thus, also including the piping and its connection to each of the elements of the refrigerant circuit inside the sealed container provides for a more secure arrangement and ensures that each of the connection points between the elements inside the sealed container and their piping connecting to the outside of the sealed container can also be protected. Accordingly, leaking flammable refrigerant can be impeded from flowing to the indoor space in an uncontrolled manner and from being exhausted to the indoor space in an insufficient height required for diluting the flammable refrigerant.

According to a ninth aspect, particularly applicable to enhanced tightness refrigerating systems, the release opening is situated at least 1.8 m above a ground (floor) of the indoor space, when the outer casing of the indoor unit is installed. Alternatively, the release opening is situated below 1.8 m relative to the ground (floor) of the indoor space when the outer casing of the indoor unit is installed and a fan for at least circulating air in the indoor space is provided.

In case of having, e.g., a floorstanding indoor unit, the height can be measured from the ground or floor of the indoor space, which is in direct contact with a base plate or stand of the indoor unit. In this case, the installed height is 0 m and the height of the release opening corresponds to the release offset. Yet, different arrangements of the indoor unit, for example on a shelf or a platform, are also applicable. In such cases, the release opening height is not calculated from the platform being in contact with the indoor unit, but also from the ground of the indoor space. Even when several elements are arranged between the indoor unit (comprising the release opening) and the ground of the indoor space, the release opening height is calculated from the ground of the indoor space to the release opening—irrespective of the number of elements arranged in between. To put it differently, the release opening height (release height) is calculated as the sum of the installed height of the indoor unit and the release offset (see above).

Thus, when the indoor unit is positioned inside the indoor space, the arrangement of the release opening at least 1.8 m above the ground ensures that a sufficiently high release opening is achieved. This allows to sufficiently disperse the leaking flammable refrigerant. This applies, specifically for small indoor spaces, such as an indoor space having an area of less than 200 $m^2$. On the other hand, when the indoor unit is positioned inside the indoor space so that the release opening is arranged below 1.8 meters relative to the ground of the indoor space and a fan is provided in the indoor space, the fan ensures that the air in the indoor space is circulated so that any leaking refrigerant is sufficiently diluted and a concentration of refrigerant in the indoor space is kept below an ignition point.

According to a tenth aspect particularly applicable to non-enhanced tightness refrigerating systems, the release opening is situated at a height above a ground of the indoor space, when the outer casing of the indoor unit is installed, which is equal to or higher than the higher result of the following formulas:

$$H \geq \frac{mc}{35 * LFL^{\frac{5}{4}}} \text{ OR } H \geq \frac{mc}{150 * LFL}$$

Considering said formulas, "H" reflects the minimum height of the release opening measured from a ground of the indoor space, "me" reflects a mass of the refrigerant in the refrigerant circuit and "LFL" reflects a low flammability level coefficient, wherein, for example, the low flammability coefficient commonly applied for R32 is 0.307.

According to such an arrangement, it is possible to provide a sufficiently high release opening of the sealed container inside a room, while also taking into consideration the amount of refrigerant used in such a system. Further mechanical elements such as a fan or the like providing a ventilation inside the room can in many cases be avoided by such an arrangement. This provides a simple and secure heat pump. With respect to this tenth aspect, the minimum height of the release opening should at least be 0.6 m.

The term "sealed" in accordance with the present disclosure is not necessarily to be understood as excluding any openings. Hence, according to an eleventh aspect, a cumulation of all openings in the scaled container, other than the release opening, is smaller than 5 $cm^2$. In this context, the "openings" are to be understood as openings communicating the interior of the scaled container with an exterior environment of the sealed container. Further, a single dimension, such as the diameter, of such an opening considered in the cumulation is more than 0.1 mm. Accordingly, openings having a dimension, such as a diameter, smaller than 0.1 mm are not considered as openings where leaking refrigerant can escape.

According to a twelfth aspect, the sealed container is an airtight container.

The "air-tightness" should be understood in such a manner, that refrigerant inside the sealed container should not leak from said sealed container when an overpressure up to three times a reference pressure is applied in the sealed container with completely closed release opening. The reference pressure is the pressure that is generated in the event of a leak when all the refrigerant in the refrigerant circuit is leaked into the sealed container in four minutes with an open release opening. This reference pressure will depend on e.g. the cross section of the release opening and possible measures to prevent foreign matters from entering the sealed container via the release opening.

Having an airtight container further increases the safety of the heat pump using flammable refrigerant.

According to a thirteenth aspect, piping connecting to at least one of the compressor, the utilisation-side heat exchanger, the expansion device and the heat-source-side heat exchanger which is/are accommodated in the sealed container passes through the release opening for connecting to the remainder of the refrigerant circuit.

According to such an arrangement, it is possible to achieve a simple configuration of the sealed container, wherein all elements provided therein are merely connected by piping which enters and exits the sealed container via its release opening. Hence, other openings that have to be sealed can be avoided and a simple end well-sealed arrangement can be achieved.

According to a fourteenth aspect, the refrigerant circuit contains the flammable refrigerant and/or the refrigerant consists of R32 or comprises R32.

According to an embodiment, the sealed container according to any of the preceding aspects is manufactured by at least one single metal sheet, by a single deep-drawn metal sheet, or by molded material.

When accommodating at least one of the compressors, the utilization-side heat exchanger, the expansion device and the heat-source-side heat exchanger, there is a risk of sweat (condensation water) occurring on the respective component. Such condensation water may accumulate in the sealed container. In order to counteract the accumulation or water in the sealed container, different measures may be taken which may be embodied independently but also together. For example, the component accommodated in the scaled container, such as utilization-side heat exchanger, may be insulated to avoid or at least reduce the occurrence of sweat on the surfaces of the component. Another measure may be to provide a heater in the sealed container so that any condensation water accumulating in the sealed container can be evaporated and exhausted through the release opening. An even further measure is to provide a drainage pipe or drainage opening to drain any water from the sealed container, the drainage pipe/opening comprising a controlled valve. The controlled valve should allow a fluid flow from the sealed container through the drainage pipe/opening out of the sealed container but avoid refrigerant to be exhausted through the drainage pipe/opening upon leakage of refrigerant into the sealed container 20. Thereby, any humidity is prevented from entering the sealed container so that the likelihood of condensation water being formed on the components inside the sealed container is reduced or even avoided and condensation water accumulating inside the sealed container may be drained.

According to a fifteenth aspect, a method for installing a heat pump as described above comprises the step of installing the outer casing of the indoor unit of the heat pump in the indoor space, wherein the release opening of the sealed container is arranged at least 1.8 m above the ground of the indoor space.

Such an arrangement of a simple and safe heat pump configuration provides sufficient and controlled dilution of potentially leaking flammable refrigerant to the indoor space. This prevents a dangerous flammable refrigerant concentration. Further, such an arrangement allows to eliminate the requirement for additional mechanical ventilation inside a small indoor space having, e.g. an area of 200 $m^2$. Additionally, positioning the release opening at this height allows to avoid mechanical ventilation, such as provision of the fan in the indoor space, when the indoor unit is part of an in enhanced tightness refrigerating system (see above).

According to a sixteenth aspect, a method for installing a heat pump as described above comprises the step of installing the outer casing of the indoor unit of the heat pump in the indoor space, wherein a fan is provided in the indoor space for at least circulating the air in the indoor space. In this context, it is to emphasize that the fan does not need to replace air in the indoor space, i.e. to actively vent the indoor space even though such ventilation may be provided. However, the fan induces air movement by the fan so that the refrigerant and the air in the room are mixed. As a result, the refrigerant is a diluted and the risk of ignition of the refrigerant reduced. The fan may be part of a ventilation system actively venting the indoor space. In addition, the fan may be continuously driven or triggered by detection of a refrigerant leakage. When providing the fan in the indoor space, the release opening may even be positioned below 1.8 m above the ground (floor) of the indoor space. This particularly applies to indoor units of enhanced tightness refrigerating systems.

Due to said arrangement, a compact and secure arrangement can be achieved which, by help of the fan, sufficiently dilutes an air/refrigerant mixture inside the indoor space. Said configuration also counteracts a potential concentration of leaking flammable refrigerant inside said indoor space.

According to a seventeenth aspect, a method for installing a heat pump as described above comprises the step of installing a heat pump and comprises the step of installing the outer casing of the indoor unit of the heat pump in the indoor space, wherein the release opening of the sealed container is arranged at a height above a ground of the indoor space, when the outer casing of the indoor unit is installed, which is equal to or higher than the higher result of the following formulas:

$$H \geq \frac{mc}{2.5 * LFL^{\frac{5}{4}} * A^{\frac{1}{2}}} \text{ OR } H \geq \frac{mc}{SF * LFL * A}$$

In this context "H" reflects the minimum height of the release opening measured from a ground of the indoor space, "me" reflects a mass of the refrigerant in the refrigerant circuit and "LFL" reflects a lower flammability limit. "SF" reflects a safety factor, wherein SF is 0.75 and "A" represents the area of the indoor space, wherein A is for example 200 $m^2$. This particularly applies to indoor units of non-enhanced tightness refrigerating systems. Further, the minimum height of the release opening should in these cases be at least 0.6 m.

Such an arrangement of a simple and safe heat pump configuration provides sufficient and controlled dilution of potentially leaking flammable refrigerant to the indoor space. This prevents a dangerous flammable refrigerant concentration. Further, such an arrangement allows to eliminate the requirement for additional mechanical ventilation, such as a fan, inside a small indoor space.

More complete appreciation of the invention and many of the attendant advantages thereof will be readily obtained as the same becomes better understood by the reference to the following detailed description when considered in connection with the accompanying drawings.

DETAILED DESCRIPTION OF EMBODIMENT(S)

Subsequently, several embodiments of the heat pump of the present invention will be described in detail.

In general, a heat pump comprises a refrigerant circuit, which, in the present embodiments, is configured to circulate flammable refrigerant. Refrigerant used in the exemplary embodiments of the present invention consists of R32, as R32 enables efficient heat exchange while having a low GWP. Usually, R 32 comprises a higher density than air under atmospheric pressure. Thus, R32 usually concentrates at bottom sections of spaces or volumes. Issues stemming from the density of R32 and its flammability characterises will be described in more detailed below. Further, other flammable refrigerants can also be used in the context of the present invention.

The refrigerant circuit used in the heat pump of the present invention corresponds to a commonly known refrigerant circuit, which comprises at least a compressor, a utilization-side heat exchanger (e.g. for domestic hot water or space heating/cooling such as air conditioning or floor heating), an expansion device (e.g. main expansion valve) and a heat-source-side exchanger (e.g. outdoor air heat exchanger or ground source heat exchanger). All elements are connected by piping, such that refrigerant can flow from one component to the other and can achieve heat exchange with a second medium.

The subsequently described exemplary embodiments of the heat pump relate to an air heat pump, wherein the above-noted elements of the refrigerant circuit are separately housed in an outdoor unit and indoor unit.

The exemplary (not illustrated) outdoor unit accommodates at least the main expansion valve, the compressor and the heat-source-side heat exchanger, whereas the exemplary indoor unit 10, which will be described in more detail below, accommodates at least the utilization side heat exchanger 19. This provides for a quiet and compact design of the indoor unit 19. Nonetheless, other configurations and arrangements of the refrigerant circuit in the indoor unit 10 and the outdoor unit an also applicable.

Figure 1:
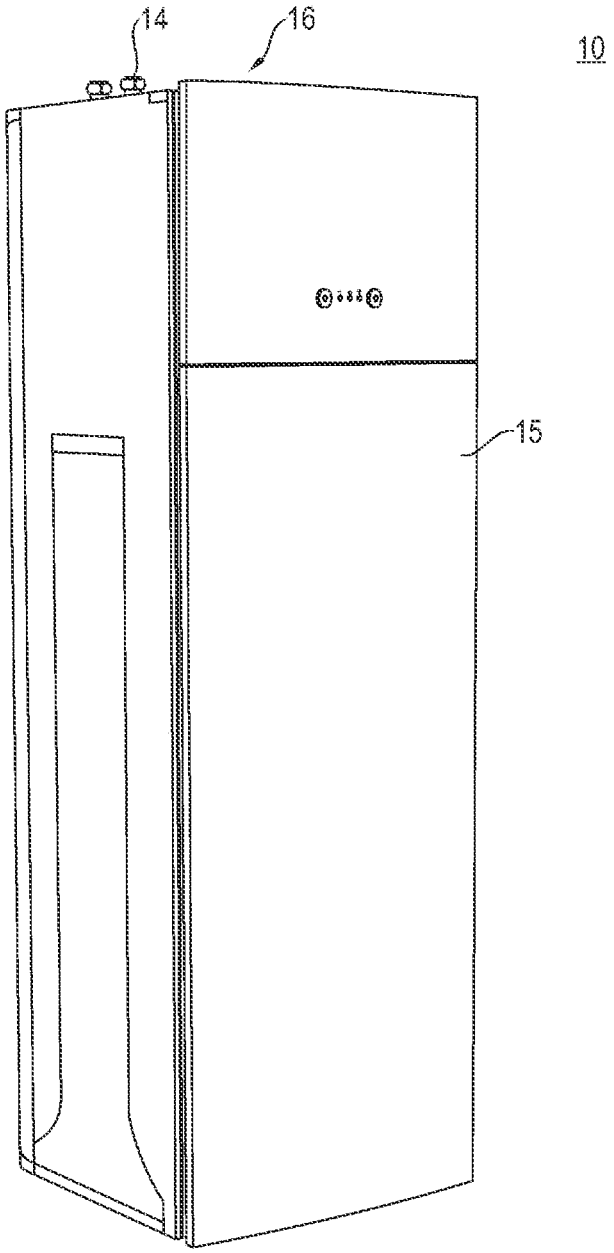
FIG. 1 shows an overall structure of an indoor unit of a heat pump according to the present invention.

An exemplary embodiment of such an indoor unit 10 of an air heat pump is illustrated in FIG. 1. FIG. 1 shows a floorstanding indoor unit 10 for producing hot water e.g. as domestic hot water and/or space heating, which can be placed on the ground of an indoor space, i.e. a room inside a building, in which hot water should be produced. Yet, a wall-mounted indoor unit may also be applicable. The produced hot water can, for example, be used for bathroom applications (shower, bathtub, etc.), in the kitchen or for underfloor heating systems in a household.

Figure 2:
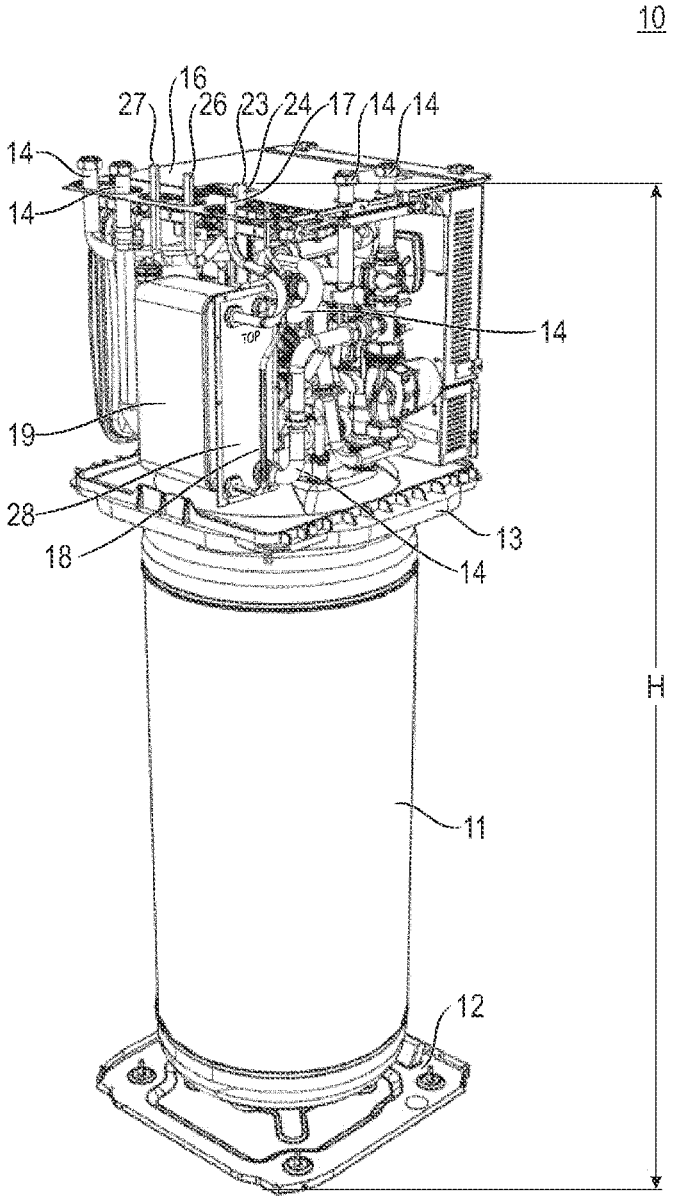
FIG. 2 shows the overall structure of the indoor unit of FIG. 1 with the outer casing of the indoor unit and part of the sealed container being omitted.

FIG. 2 illustrates the overall configuration of the floor-standing indoor unit 10 shown in FIG. 1, wherein the lateral part of the outer casing 15 thereof has been removed.

To start from the (not shown) ground of the indoor space, on which the indoor unit 10 is placed, an isolated tank 11 is provided on a base plate 12, wherein the lateral outer casing 15 of the indoor unit 10 (not shown in FIG. 2) can be mounted thereto.

The isolated tank 11 can be made of stainless steel and can be covered by an isolation material. The isolated tank 11 stores the domestic hot water generated by the indoor unit 10 and efficiently avoids a rapid cool down of the generated hot water. This enables that hot water is directly and permanently available at any time. In the exemplary embodiment of the floorstanding indoor unit 10 the isolated tank 11 may have a volume of 180 to 230 litres. Nonetheless, the present application is not limited thereto, and other volumes are also applicable.

A drain pan 13 is provided above said isolated tank 11 to allowed drainage of any condensation water accumulated on the drain pan. In the exemplary embodiment of FIGS. 1 and 2, all elements required for producing hot water inside the indoor unit 10 are provided above said drain pan 13 and will be described in more detail below.

Above that, the outer casing 15 of the indoor unit 10 comprises a top 16 that forms the top section of the outer casing 15 of the indoor unit 10.

Water connection pipes 14 protrude from said top 16 of the outer casing 15 to provide a top connection of the indoor unit 10 of the heat pump. That is, the water connection pipes 14, in the present embodiment, may be part of a closed loop and connect the indoor unit 10 to at least one heating application such as a floor heating, a radiator, an air heating or the like. Additionally, a coil immersed in a domestic hot water tank (isolated tank 11) may be part of said closed loop to heat water contained in the domestic hot water tank. Accordingly, the water connection pipes 14 enable to stream, e.g., relatively hot water out of the indoor unit 10 to its desired application inside the household, and to stream relatively cold water into the indoor unit 10. A domestic hot water pipe 26 and a freshwater pipe 27 are provided to respectively withdraw hot water from the domestic hot water tank and feed freshwater to the domestic hot water tank for refilling.

In the present embodiment, water in the closed loop flowing into the indoor unit 10 is guided through the utilization-side heat exchanger 19 of the indoor unit 10. Inside said utilization side heat exchanger 19, the water exchanges heat with the refrigerant of the refrigerant circuit, here R32, and, hence, is heated. Subsequently, the heated water is flown out of the utilization-side heat exchanger 19 and flown through a coil disposed in the isolated tank 11 so that water contained in the isolated tank 11 is heated. In addition (as in the present embodiment) or as an alternative the heated water may be directly flown to at least one heating application, such as a floor heating, radiator, an air heating or the like. If required a switching device can be provided so that the heated water may be circulated through the coil for producing domestic hot water or the at least one heating application for space heating depending on the demand. If hot water is required for a domestic application, such as a tap water, it may then be taken out of the isolated tank 11 and be flown via domestic hot water pipe 26 out of the indoor unit 10 to its domestic application, e.g. in the same or a different room of the house. For refilling the isolated tank 11, cold water is flown into the tank via a freshwater pipe 27. Certainly, the invention is not limited in this regard and other embodiments are conceivable.

To achieve the above-mentioned heat exchange between hot, gaseous R32 and cold water inside the utilization-side heat exchanger 19, hot, gaseous R32 is streamed from the (not shown) outdoor unit into the utilization side heat exchanger 19 via a gaseous refrigerant pipe 17.

Consequently, heat between the hot, gaseous refrigerant entering the utilization-side heat exchanger 19 via the gaseous refrigerant pipe 17 and the cold water can be exchanged in said utilization-side heat exchanger 19. Vice versa, not only the water is heated thereby, but the temperature of the refrigerant is reduced accordingly. Depending on the desired application, the heat exchange can be performed in both, a parallel flow or counter flow inside the utilization-side heat exchanger 19.

Due to the described cool down of the refrigerant during the heat exchange inside the utilization-side heat exchanger 19, the refrigerant gets liquidated, exits the utilization-side heat exchanger 19 via a liquid refrigerant pipe 18, and is then streamed out of the indoor unit 10 and back to the (not shown) outdoor unit of the refrigerant circuit. Therein, the temperature of the refrigerant is increased again due to a compression and a heat exchange inside the heat-source-side heat exchanger of the refrigerant circuit. The refrigerant can then be used for a further heat exchange with cold water inside the utilization-side heat exchanger 19 to produce, e.g., hot water.

Further commonly known elements of an air heat pump indoor unit, such as air purge valves, a magnetic filter, a controller, a three-way-valve, a flow sensor, an expansion vessel, a pressure sensor, a backup heater, a connection terminal, a switch box, a user interface, a circulation pump, etc. are not relevant for the description of the exemplary embodiments and are well known to a skilled person, such that a further description thereof will be omitted. Accordingly, some of the elements are also not illustrated in the drawings for orientation purposes.

Figure 3:
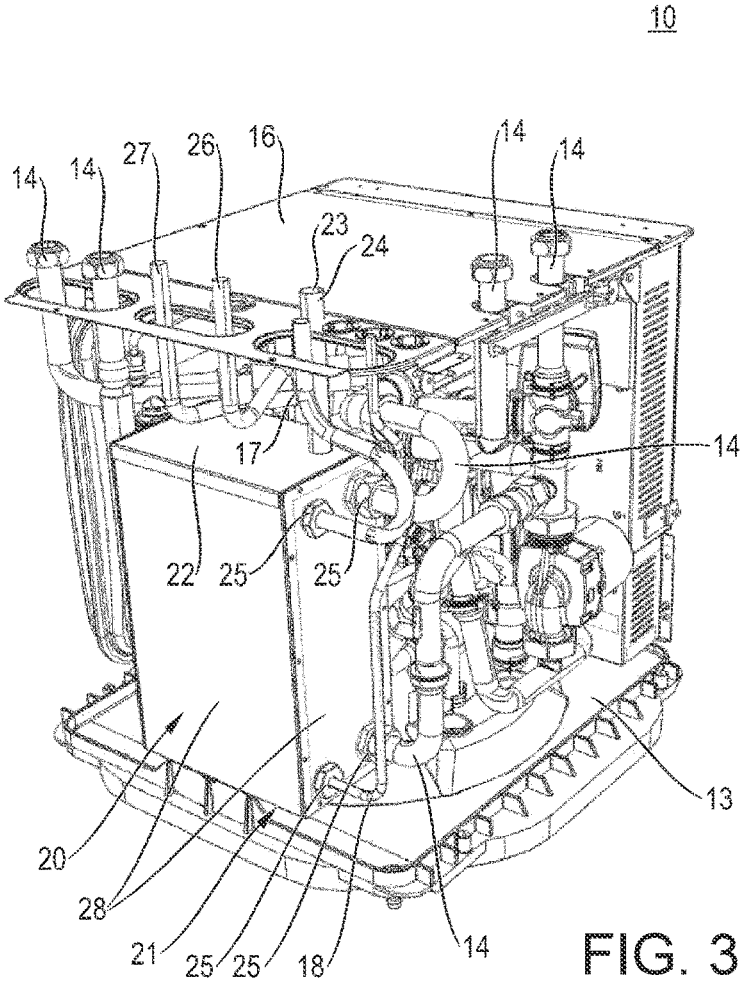
FIG. 3 shows an upper section of the indoor unit of FIG. 2, but with the sealed container arranged therein.

FIG. 3 shows an upper part of the indoor unit 10 of the exemplary embodiment shown in FIGS. 1 and 2. It is adherent from FIG. 3 that the indoor unit 10 comprises a sealed container 20, which is accommodated inside the outer casing 15 of the indoor unit 10. Said sealed container 20 is an airtight container, which in the present embodiment comprises a bottom 21 and a top 22 and can accommodate at least one of the compressor, the utilization-side heat exchanger 19, the expansion device, and the heat-source-side heat exchanger. Even though the present embodiment shows the sealed container as being configured as a sheet metal box, other configurations are as well conceivable.

Figure 4A:
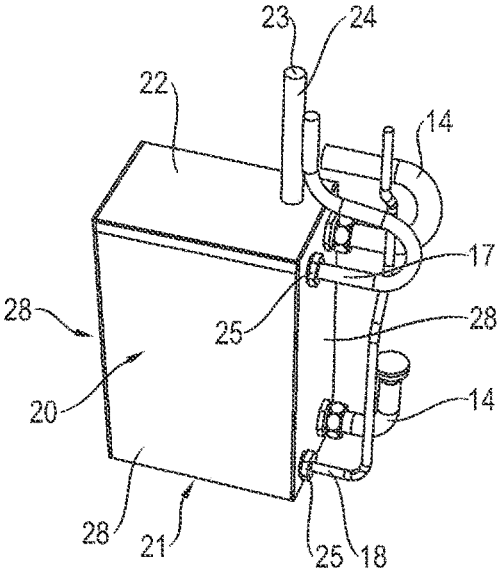
FIG. 4A shows the scaled container of FIG. 3 in isolation.
Figure 4B:
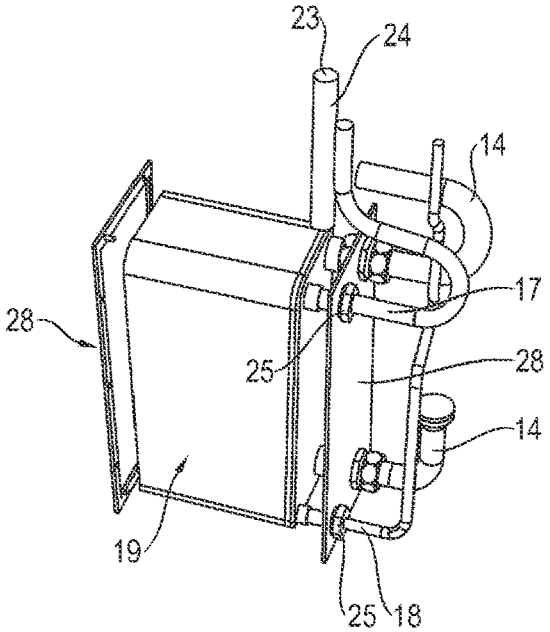
FIG. 4B shows the sealed container of FIG. 4A with the top, bottom and two side walls being omitted.
Figure 5:
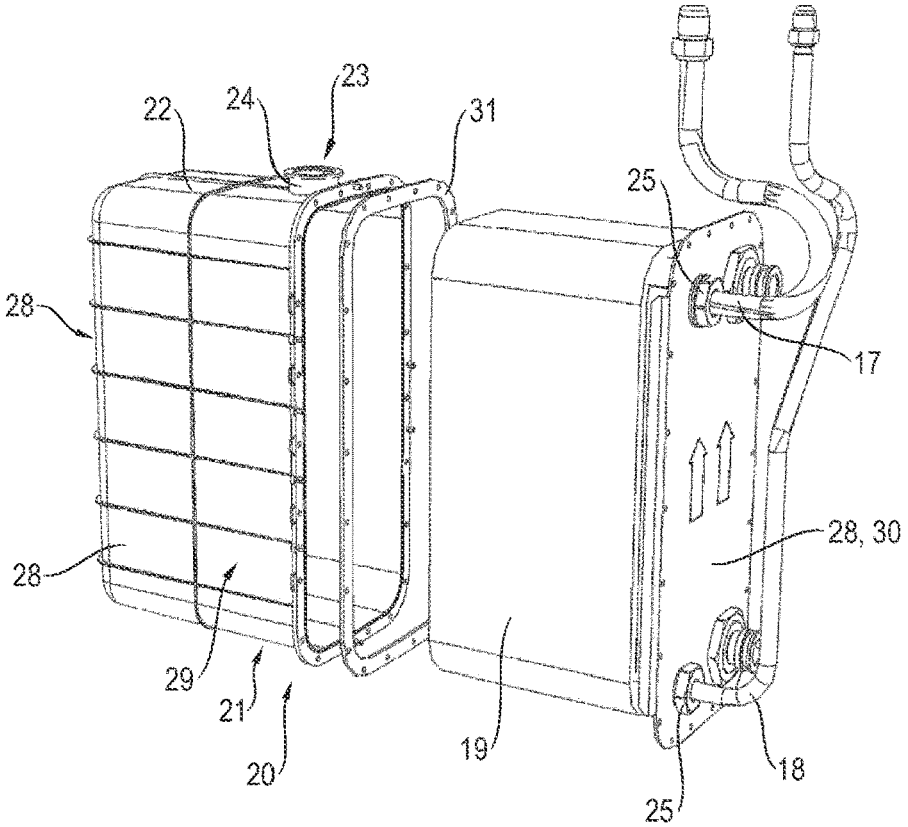
FIG. 5 shows another embodiment of the sealed container partly as explosive view.

One such example is shown in FIG. 5. In this example, the sealed container 20 may be made of at least two members of different material. The two members may comprise a shell 29 made of e.g. plastic material and a lid 30 made of e.g. sheet metal. The shell 29 substitutes for example four of the sheet metals of the embodiment shown in FIG. 4, for example those resembling the bottom 21, the top 22 and three of the side walls 28. One remaining side wall 28, particularly that through which the pipes 14, 17, 18 pass and comprising the sealed contact areas 25, is maintained as lid 30 of sheet metal. As compared to a sheet metal box, wherein sealings are required between each and every sheet metal, this embodiment merely requires one sealing 31 between the shell 29 and the lid 30. The chimney 24, in this embodiment, is shown relatively short so that the release opening 23 is situated only slightly above the top 22. Yet, in other embodiments, the chimney 24 may be extended by a tube or pipe so as to provide the release opening 23 at a higher position similar as shown in the embodiment in FIG. 3.

In the exemplary embodiments described herein, the sealed container 20 exemplarily accommodates and completely covers the utilization side heat exchanger 19. It is highlighted in this regard, that the sealed container is not shown in FIG. 2 except for the side walls 28 through which the gaseous refrigerant pipe 17, the liquid refrigerant pipe 18 and the water connection pipes 14 pass. Additionally, the scaled container 20 is shown in isolation in FIG. 4A and in order to show its interior with the bottom 21, the top 22 and two of the side walls 28 being removed in FIG. 4B.

Nonetheless, it is also possible that at least one or all of the compressor, the expansion valve and the heat-source-side heat exchanger are also accommodated in the sealed container. In such a configuration the sealed container 20 can then be the outer casing of the indoor unit 10.

Providing a scaled container 20 that completely covers and accommodates the utilization side heat exchanger 19 of the indoor unit 10 enables to avoid issues related to potentially leaking refrigerant inside the utilization side heat exchanger 19. Said configuration may avoid an uncontrolled exhaust of flammable refrigerant, here R32, into the indoor space, in which the indoor unit 10 is arranged. Water and refrigerant piping entering or leaving the sealed container 20 for connecting the utilization-side heat exchanger 19 with the refrigerant circuit and the above-described water circuit penetrate through the walls of the sealed container in the embodiment of FIGS. 1 to 3. Yet, said penetration areas are also sealed, such that an uncontrolled exhaust of leaking refrigerant can be also avoided at said sealed contact areas 25 of the sealed container 20.

To avoid that the pressure inside said sealed container 20 rises due to leaking refrigerant and to prohibit an uncontrol exhaust of the leaked flammable refrigerant into the indoor space, the sealed container 20 comprises a release opening 23. Said release opening 23 enables that leaking refrigerant can be exhausted to the exterior of the outer casing 15 of the indoor unit 10 in a more controlled manner. This enables that a sufficient dispersion of exhausted flammable refrigerant can be achieved and the risk of flammable refrigerant concentration in the indoor space can be prohibited.

It becomes apparent from a comparison of FIGS. 2, 3 and 4A, 4B that also the connection of the utilization side heat exchanger 19 to the piping of the refrigerant circuit is arranged inside the sealed container 20 and only the piping of the refrigerant circuit and the water connecting pipes enter/exit the sealed container 20. Thus, the potential leaking points, namely the utilization side heat exchanger 19, such as a plate heat exchanger, and the connection of the utilization side heat exchanger 19 to the piping of the refrigerant circuit are arranged in the sealed container 20. To put it differently, brazing connections at which leakage likely occurs are disposed within the sealed container 20. Accordingly, risks stemming from leaking refrigerant at said connection points of the utilization side exchanger 19 to the remaining part of the refrigerant circuit can be reduced, as said leaking refrigerant would merely leak into the sealed container and could then be exhausted to the exterior of the outer casing 15 of the indoor unit 10 via the release opening 23 in a more controlled manner.

To achieve such a controlled release of leaking refrigerant via the release opening 23, the leaked refrigerant must be exhausted sufficiently high. In the embodiment shown in FIG. 3, the sealed container 20 comprises a chimney 24 having a rust end and a second end. The first end of the chimney 24 is in fluid communication with an interior of the sealed container 20, in which the utilization-side heat exchanger 19 is arranged. Vice versa, the release opening 23 of the sealed container 20 is arranged at the second end of the chimney. This chimney 24 aims to increase the release height of leaking refrigerant. This provides a sufficient dispersion of the leaked refrigerant inside the indoor space, while keeping the overall size of the indoor unit 10 small.

In the exemplary embodiment of FIGS. 1 to 3, the chimney 24 represents a straight pipe, wherein the first end is a lower end of the chimney and the second end is a at a higher position than the first end.

Further, the chimney 24 of the embodiment of FIGS. 1 to 3, and accordingly also the release opening 23 of the sealed container 20, protrudes through the top 16 of the outer casing 15 of the indoor unit 10 in a height direction to exhaust leaking refrigerant to the exterior of the outer casing 15 as high as possible.

Exhausting leaking flammable refrigerant as high as possible ensures that a sufficient dilution of leaking R32 can be achieved and flammable refrigerant concentration inside the indoor space can be avoided. Specific requirements for the height of the release opening are exemplified in more detail below.

In further, not illustrated embodiments, it is also possible that the chimney 24 extends in a horizontal direction, such that the first end and the second end of the chimney 24 are arranged at the same (height) level.

It is also possible that the chimney 24 protrudes from a side surface of the sealed container 20. Said side surface represents a vertical surface of the sealed container that is arranged between the bottom 21 and the top 22 of the sealed container 20.

In this context, the chimney 24 may comprise a "L"-shape, such that a second end thereof opens in a direction facing away from the base plate 11 of the indoor unit 10 and is arranged at a higher position than the first end of the chimney 24 being in fluid communication with the inside of the sealed container 20. Such a configuration is exemplarily shown in the embodiment of FIG. 6.

Figure 6:
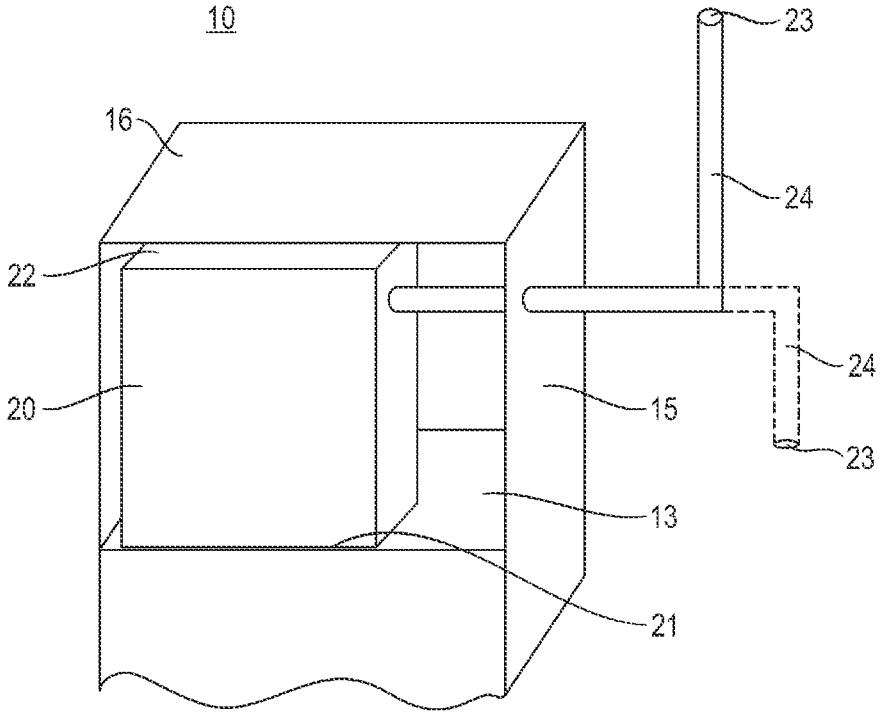
FIG. 6 shows an alternative embodiment for the arrangement of the chimney in the indoor unit.

FIG. 6 represents a facilitated cross-sectional view of the upper section of a similar indoor unit 10 than the one described with respect to FIGS. 1 to 4B. FIG. 6 merely differs in the shape and arrangement of the chimney 24. Accordingly, the redundant description of similar elements than in the embodiment of FIGS. 1 to 4B is omitted. Further, it is highlighted that the connection of the gaseous refrigerant pipe 17 and the water connection pipe 14 at the upper section of the sealed container 20 are omitted in FIG. 6 for orientation purposes as well.

Nonetheless, it is, with respect to the embodiment of FIG. 6, adherent that also the release opening 23 of the "L"-shaped chimney 24 at the second end of the chimney 24 of FIG. 6 is positioned at a height H above the ground of the indoor space as explained above. In one particular embodiment, the release opening 23 of the chimney 24 of FIG. 6 is positioned above the top 16 of the outer casing 15. In either case, leaking refrigerant inside the sealed container 20 can be exhausted at a sufficiently high position in this embodiment. Such an arrangement provides a simple, secure and flexible arrangement of the utilization-side heat exchanger 19 inside the indoor unit 10. In an other embodiment, depicted by the dashed lines in FIG. 6, the chimney 24 may be directed downwards, i.e. the release opening 23 is facing the floor. Thus, the risk of foreign matter entering the sealed container 20 via the chimney 24 is reduced. In the shown embodiment, the release opening 23 is disposed lower than the bottom 21 of the sealed container 20. Yet, care must be taken that the height of e release opening 23 still fulfills the above-described requirements.

Figure 7:
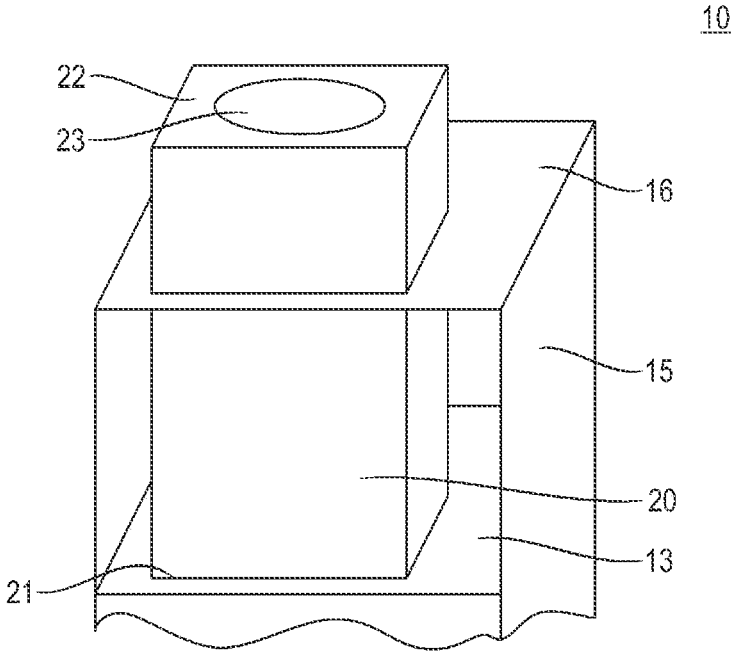
FIG. 7 shows another alternative embodiment of the indoor unit having a sealed container, which protrudes from the top of the outer casing of the indoor unit.

A further, alternative indoor unit embodiment is shown in the cross-sectional view of FIG. 7. Said embodiments differs from the embodiments described above in the configuration of the sealed container 20 and the release opening 23 and does not require a chimney. Nonetheless, the description of similar elements than the ones of the previously described embodiments will be omitted.

The release opening 23 of the embodiment of FIG. 7 is arranged in the top 22 of the scaled container 20. Further, the scaled container 20 protrudes through the top 16 of the outer casing 15 of the indoor unit 10.

Accordingly, the provision of a chimney can be omitted and a simple configuration for releasing potentially leaking flammable refrigerant at the highest possible position of the indoor unit can be achieved.

In a further, not shown embodiment, it is possible that the release opening 23 of the embodiment of FIG. 7 extends over the whole diameter of the top of the sealed container 20. In other words, the sealed container 20 is fully opened at its top 22, such that dispersion of leaking flammable refrigerant in the utilization-side heat exchanger 19 can be achieved by an exhaust at the highest possible position. Further, this facilitates the arrangement of the utilization-side heat exchanger 19 inside the sealed container 20.

Figure 8:
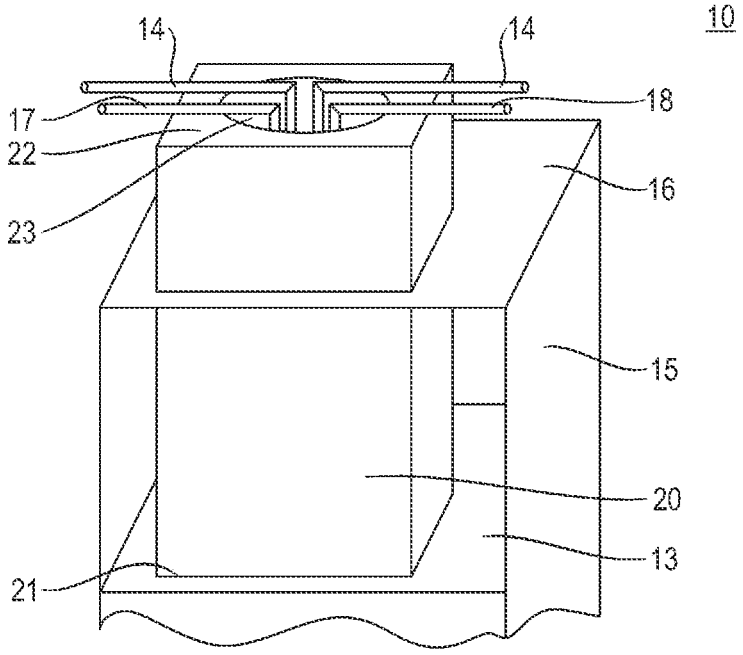
FIG. 8 shows an alternative arrangement of piping to and from the sealed container, passing through the release opening.

A further embodiment is shown in the cross-sectional view on part of the indoor unit 10 of FIG. 8. In this embodiment, the utilisation-side heat exchanger 19, which is accommodated in the sealed container 20 and all corresponding water and refrigerant pipings, such as the gaseous refrigerant pipe 17, the liquid refrigerant pipe 18 as well as the water connecting pipes 14, enter and leave the scaled container 20 through the release opening 23.

An arrangement of the pipings entering and exiting the scaled container 20 through the release opening 23 enable to avoid scaled contact areas 25, e.g. in the side walls of the sealed container 20, through which leaked refrigerant could potentially be exhausted from the sealed container 20 in an uncontrolled manner. Accordingly, the safety of such an indoor unit 10 can be improved.

Please note that such an arrangement works with all of the above described embodiments, namely the ones having a chimney 24 and the ones having a release opening 23 in the top 22 of the sealed container 20 that protrudes from the top 16 of the indoor unit 10.

Irrespective of the actual configuration and arrangement of the sealed container 20, the chimney 24, the release opening 23 or the like, it once again highlighted that it is important to situate the release opening 23 of the sealed container 20 as high as possible above a ground of the indoor space, when the outer casing of the indoor unit is installed therein.

This enables that, if flammable refrigerant is leaking out of the utilization-side heat exchanger 19 or at its connection points to the remaining elements of the refrigerant circuit arranged in the outdoor unit, it can primarily be gathered inside the sealed container 20. Should the amount of leaking refrigerant increase and fill the sealed container, the leaking refrigerant can then be exhausted to the exterior of the indoor unit 10 and into the indoor space at a high position via the release opening 23.

As the flammable refrigerant used in the above-described embodiments has a higher density than air under atmospheric pressure, the flammable refrigerant will gather at a bottom section of the indoor space. This may provoke a dangerous concentration of flammable refrigerant inside the indoor space, which may, in a worst-case scenario, lead to an inflammation.

Accordingly, all embodiments described above aim to, primarily, -position all potential refrigerant leakage points inside the sealed container. Thus, the height where refrigerant is released from the sealed container can reliably be determined/defined and adjusted to the needs, in particular by appropriately arranging the release opening. Particularly, the refrigerant can be released so as to guarantee sufficient dilution of the refrigerant in the indoor space. This reduces the risk of a flammable refrigerant concentration inside the indoor space.

Having a release opening 23 at an end of a chimney 24 or at a top 22 of sealed container 21 that protrudes from the top of the indoor unit, enables to achieve said dispersion due to the sufficient height of the release opening, respectively.

In this light, all described embodiments relate to enhanced tightness refrigerating systems and exhaust the flammable refrigerant via the release opening 23 at least 1.8 m above the ground of the indoor space, in which the indoor unit is situated. The height H of the release opening has been highlighted in FIG. 2 for orientation purposes. Accordingly, no ventilation or the like is required—also in small indoor space (such as domestic households) having an overall area of the indoor space of 200 $m^2$ or less.

Nonetheless, arrangements with a lower release height via the release opening 23 are also applicable. In this context, it is possible to arrange the release height of leaked flammable refrigerant via the release opening 23 below 1.8 m relative the ground of the indoor space in which the indoor unit is arrangement. Yet, said configurations may require additional means to guarantee safe handling in the case of leakage. An example of such additional means is a fan increasing the mixing of the leaked refrigerant with the available air volume in the indoor space or even exchanging the air in the indoor space by use of actively venting the indoor space. The fan may be operated continuously or starting the fan may be triggered by detecting a refrigerant leak. Thus, sufficient dispersion of the leaked flammable refrigerant in the interspace may be achieved. Other examples which may be embodied comprise alarm functions or evacuation of the refrigerant present in the refrigerant circuit to a location within the refrigerant circuit where it can safely be stored, such as an outdoor unit of the heat pump.

For non-enhanced tightness refrigerating systems, the height of the release opening 23 must be equal to or higher than the higher result of the following formulas:

$$H \geq \frac{mc}{2.5 * LFL^{\frac{5}{4}} * A^{\frac{1}{2}}} \text{ OR } H \geq \frac{mc}{SF * LFL * A}$$

H reflects the minimum height of the release opening 23 measured from a ground of the indoor space, me reflects a mass of the refrigerant in the refrigerant circuit, LFL reflects a lower flammability limit of the used refrigerant, SF reflects a safety factor, and A represents the area of the indoor space. The lower flammability limit of R32 can exemplarily be considered as LFL=0.307, the safety factor as SF=0.75 and the area of the indoor space as A=200 $m^2$.

Inserting the above-mentioned values of SF=0.75 and A=200 $m^2$ in the formulas above provides the following formulas:

$$H \geq \frac{mc}{35 * LFL^{\frac{5}{4}}} \text{ OR } H \geq \frac{mc}{150 * LFL}$$

Yet, other values for the area of the indoor space A, the safety factor SF, etc. are also applicable. Said height H of the release opening has been highlighted in FIG. 2 for orientation purposes.

In case of installing an indoor unit in the form of a floorstanding indoor unit, the height can be measured from the ground or floor of the indoor space, which is in direct contact with a base plate or stand of the indoor unit. Yet, different installations of the indoor unit, for example on a shelf or a platform, are also applicable. In such cases, the release opening height is not calculated from the platform being in contact with the indoor unit, but from the ground of the indoor space, which is in contact with the platform. Even when several elements are arranged between the indoor unit (comprising the release opening) and the ground of the indoor space, the release opening height is calculated from the ground of the indoor space to the release opening of the sealed container—irrespective of the number of elements arranged in between. In any case, for non-enhanced tightness refrigerating systems, the minimum height of the release opening above the ground (floor) of the indoor space should be 0.6 m.

What is claimed is:

1. A heat pump, comprising:

a refrigerant circuit configured to circulate flammable refrigerant, the refrigerant circuit having a compressor, a utilisation-side heat exchanger, an expansion device and a heat-source-side heat exchanger connected by piping; and an indoor unit configured to be arranged in an indoor space, the indoor unit including an outer casing having a top and a bottom opposite the top, the top being the uppermost surface of the outer casing, the bottom supporting the outer casing, and a sealed container accommodated in the outer casing, the sealed container having a bottom and a top and accommodating at least one of the compressor, the utilisation-side heat exchanger, the expansion device, and the heat-source-side heat exchanger, the sealed container having a release opening to exhaust leaking refrigerant to an exterior of the outer casing of the indoor unit, the sealed container including a chimney having a first end and a second end, the first end of the chimney being in fluid communication with an interior of the sealed container, and the release opening of the sealed container being arranged at the second end of the chimney, the release opening being disposed above the top of the outer casing, and the refrigerant having a higher density than that of air.

2. The heat pump according to claim 1, wherein the release opening is arranged in the top of the sealed container, and the sealed container protrudes through the top of the outer casing of the indoor unit.

3. The heat pump according to claim 1, wherein the release opening is positioned further away from the bottom than the top of the sealed container to exhaust leaking refrigerant into the indoor space.

4. The heat pump according to claim 3, wherein the release opening is positioned above the top of the outer casing.

5. The heat pump according to claim 1, wherein the utilisation-side heat exchanger is accommodated in the sealed container.

6. The heat pump according to claim 1, wherein a connection of the at least one of the compressor, the utilisation-side heat exchanger, the expansion device, and the beat-source-side heat exchanger, which is accommodated in the sealed container, with the piping is accommodated in the sealed container.

7. The heat pump according to claim 1, wherein one of the release opening is situated at least 1.8m above a ground of the indoor space, when the outer casing of the indoor unit is installed, and the release opening is situated below 1.8m relative to the ground of the indoor space when the outer casing of the indoor unit is installed, and a fan is provided in order to at least circulate air in the indoor space.

8. The heat pump according to claim 1, wherein the release opening is situated at a height H above a ground of the indoor space when the outer casing of the indoor unit is installed, the height H being at least a higher result of $mc/(35*LFL^{5/4})$ OR $mc/(150*LFL)$ such that the height H reflects a minimum height of the release opening measured from the ground of the indoor space, mc reflects a mass of the refrigerant in the refrigerant circuit, and LFL reflects a low flammability level coefficient.

9. The heat pump according to claim 1, wherein an accumulation of all openings in the sealed container, other than the release opening, having a single dimension of more than 0.1 mm and communicating an interior of the sealed container with an exterior environment of the sealed container, is smaller than 5 $cm^2$, and openings in the sealed container, other than the release opening, having a single dimension of not more than 0.1 mm are not considered as openings through which leaking refrigerant can escape.

10. The heat pump according to claim 1, wherein the sealed container is an airtight container.

11. The heat pump according to claim 1, wherein piping connecting to at least one of the compressor, the utilisation-side heat exchanger, the expansion device, and the heat-source-side heat exchanger, which is accommodated in the sealed container, passes through the release opening to the remainder of the refrigerant circuit.

12. The heat pump according to claim 1, wherein at least one of the refrigerant circuit contains the flammable refrigerant, and the refrigerant consists of R32 or includes R32.

13. A method of installing the heat pump according to claim 1, the method comprising:

installing the outer casing of the indoor unit of the heat pump in the indoor space, the release opening of the sealed container being arranged at least 1.8m above the ground of the indoor space.

14. A method of installing the heat pump according to claim 1, the method comprising:

installing the outer casing of the indoor unit of the heat pump in the indoor space, a fan being provided in the indoor space to at least circulate air in the indoor space, and the release opening of the sealed container being arranged below 1.8m above the ground of the indoor space.

15. A method of installing the heat pump according to claim 1, the method comprising:

installing the outer casing of the indoor unit of the heat pump in the indoor space, the release opening of the sealed container being arranged at a height H above a ground of the indoor space when the outer casing of the indoor unit is installed, the height H being at least a higher result of $mc/(2.5*LFL^{5/4}*A^{1/2})$ OR $mc/(SF*LFL*A)$ such that the height H reflects a minimum height of the release opening measured from the ground of the indoor space, me reflects a mass of the refrigerant in the refrigerant circuit, LFL reflects a lower flammability limit, SF reflects a safety factor, SF is 0.75, and A represents an area of the indoor space.

16. The heat pump according to claim 1, wherein the top of the outer casing and the top of the sealed container being substantially parallel, and the bottom of the outer casing and the bottom of the sealed container being substantially parallel.

* * * * *